US006226938B1

(12) United States Patent
Hodak

(10) Patent No.: US 6,226,938 B1
(45) Date of Patent: May 8, 2001

(54) CONCRETE POOL DECK AND POOL WALL SUPPORT FOR SWIMMING POOL CONSTRUCTION

(75) Inventor: Jerry Hodak, Borough of Zelienople, PA (US)

(73) Assignee: Linda M. Hodak

( * ) Notice: Subject to any disclaimer, the term of this patent is extended or adjusted under 35 U.S.C. 154(b) by 0 days.

(21) Appl. No.: 09/377,268

(22) Filed: Aug. 19, 1999

Related U.S. Application Data

(60) Provisional application No. 60/097,062, filed on Aug. 19, 1998.

(51) Int. Cl.[7] ..... E04H 3/16

(52) U.S. Cl. ..... 52/169.7; 52/250; 4/506; 249/2

(58) Field of Search ..... 52/169.7, 169.8, 52/169.9, 245, 246, 250, 608, DIG. 10; 248/152, 174, 459, 364, 903; 4/488, 506; 249/2, 10, 188, 208

(56) References Cited

U.S. PATENT DOCUMENTS

| | | | | |
|---|---|---|---|---|
| 1,990,001 | * | 2/1935 | Rutten | 52/250 |
| 3,468,088 | | 9/1969 | Miller | 52/250 |
| 3,511,002 | | 5/1970 | Fox | 52/146 |
| 4,109,324 | | 8/1978 | Cornelius . | |
| 4,124,907 | | 11/1978 | Laven . | |
| 4,413,453 | | 11/1983 | Witte | 52/127.1 |
| 4,464,802 | | 8/1984 | Glonek et al. | 4/506 |
| 4,781,000 | | 11/1988 | Bertsch et al. | 52/169.8 |
| 4,797,957 | | 1/1989 | Weir et al. | 4/506 |
| 5,025,601 | | 6/1991 | Hand | 52/169.7 |
| 5,277,004 | | 1/1994 | Frei | 52/169.7 |
| 5,325,644 | | 7/1994 | Cornelius | 52/169.7 |
| 5,330,151 | | 7/1994 | Boyack | 249/83 |
| 5,419,656 | | 5/1995 | McKinnon | 405/55 |
| 5,647,571 | * | 7/1997 | Hupp | 249/188 X |

* cited by examiner

*Primary Examiner*—James O. Hansen

(57) ABSTRACT

A swimming pool deck and pool wall support that includes a unitary shell member defining two vertically extending chambers each filled with concrete. At a first end of the shell member the chambers are connected by a web. The shell member further defines a gap extending from the web to a second end of a shell member and separating the chambers. The support may be utilized as part of a swimming pool deck and pool wall support system. A method of supporting a swimming pool deck and pool wall is also disclosed.

20 Claims, 7 Drawing Sheets

CONCRETE POOL DECK AND POOL WALL SUPPORT FOR SWIMMING POOL CONSTRUCTION

CROSS REFERENCE TO RELATED APPLICATION

This application claims the benefit of U.S. Provisional Application Ser. No. 60/097,062 filed Aug. 19, 1998, entitled "Concrete Saddle Deck Support For Swimming Pool Construction".

BACKGROUND OF THE INVENTION

1. Field of the Invention

The present invention relates to swimming pool construction and, more particularly, to a swimming pool deck and pool wall support apparatus.

2. Description of the Prior Art

It is known in the prior art to support swimming pool walls and decks utilizing a combined pool wall and pool deck support apparatus. For example, U.S. Pat. Nos. 4,109,324 and 5,325,644, both to Cornelius, each disclose a combined pool wall and pool deck support apparatus made of concrete. The Cornelius '324 patent discloses a concrete support having an X-shape. The Cornelius '644 patent discloses a concrete support that includes two trapezoidal-shaped panels which cooperate with one another in a tongue and groove arrangement.

It is also known in the prior art to provide a support for swimming pool walls and decks which consist of a hollow outer member, or shell, that is filled with a column of settleable material such as concrete. For example, U.S. Pat. No. 5,025,601 to Hand discloses a pool wall and pool deck support that includes an upright, hollow outer member that is filled with concrete. The hollow member includes a web that extends outward from the hollow member and supports the swimming pool wall.

The prior art support apparatus discussed hereinabove have certain limitations. First, these known supports are not proximally adjustable relative to the swimming pool wall and, in practice, are bulky and difficult to handle. Additionally, these prior art supports cannot be used easily with conventional, low-cost deck bracing that is typically utilized in aboveground and in-ground swimming pools.

Consequently, it is an object of the present invention to provide an easily transportable support apparatus that is simple to install and cooperates easily with conventional deck bracing.

SUMMARY OF THE INVENTION

The above object is accomplished with a support for a swimming pool deck and pool wall made in accordance with the present invention. The support generally includes a unitary shell member defining two vertically extending chambers each filled with concrete. At a first end of the shell member the chambers are connected by a web. The shell member further defines a gap extending from the web to a second end of the shell member and separating the chambers. The shell member of the support may be formed by a preformed blank configured to be foldable into the shape of the shell member. The support may further include a substantially U-shaped bracket having two ends and a connecting cross piece portion, with the ends embedded, respectively, in the concrete in the chambers defined by the shell member and with the cross piece portion extending across the web connecting the chambers. The cross piece portion is configured to attach to a brace member extending from a swimming pool wall with at least one fastener. The preformed blank may be made of cardboard. The shell member may be made of plastic or provided as a preformed concrete structure. The shell member may taper inward toward the second end. The chambers may have an open end located at the second end of the shell member.

The present invention is also a swimming pool deck and pool wall support system. The system generally includes a pool wall footer defining a perimeter of a swimming pool, a plurality of pool wall panels each secured at one end to the pool wall footer, at least one brace member attached to each of the pool wall panels, a plurality of supports cooperating with the brace members, and a swimming pool deck supported by the pool wall panels and the supports. The pool wall panels are positioned in end-to-end relationship and secured together at terminal end edges. The at least one brace member is attached to each of the pool wall panels to extend outward therefrom. The supports each include a unitary shell member defining two vertically extending chambers each filled with concrete. At a first end of the shell member the chambers are connected by a web. The shell member further defines a gap extending from the web to a second end of the shell member and separating the chambers. The brace members cooperate with the supports such that for each of the brace members, the brace member extends through the gap defined by the shell member of each of the supports. A swimming pool deck is supported by the pool wall panels and the supports.

The shell member of each of the supports may be formed by a preformed blank configured to be foldable into the shape of the shell member. The system may further include a substantially U-shaped bracket cooperating with the shell member of each of the supports. The bracket includes two ends and a connecting cross piece portion, with the ends embedded, respectively, in the concrete in the chambers defined by the shell member and with the cross piece portion extending across the web connecting the chambers of the shell member. The cross piece portion may be configured to attach to the respective brace members with at least one fastener. The preformed blank may be made of cardboard. The system may further include reinforcement bars positioned in the concrete in the chambers defined by the shell member of each of the supports. The shell member of each of the supports may be made of plastic or provided as a preformed concrete structure. The shell member of each of the supports may taper inward toward the second end. The shell member of each of the supports may be secured to the respective brace members with fasteners that extend through the web connecting the chambers of the respective shell members. The chambers defined by the shell member of each of the supports may each have an open end located at the second end of the shell member. The second end may be in contact with the pool wall footer such that when the chambers of the shell member of each of the supports are filled with concrete, the concrete forms a monolithic structure with the pool wall footer.

In addition, the present invention is a method of supporting a swimming pool deck and pool wall. Further details and advantages of the present invention will become apparent in the following detailed description in conjunction with the drawings, wherein like reference numerals designate like parts throughout.

DETAILED DESCRIPTION OF THE PREFERRED EMBODIMENTS

Figure 1:
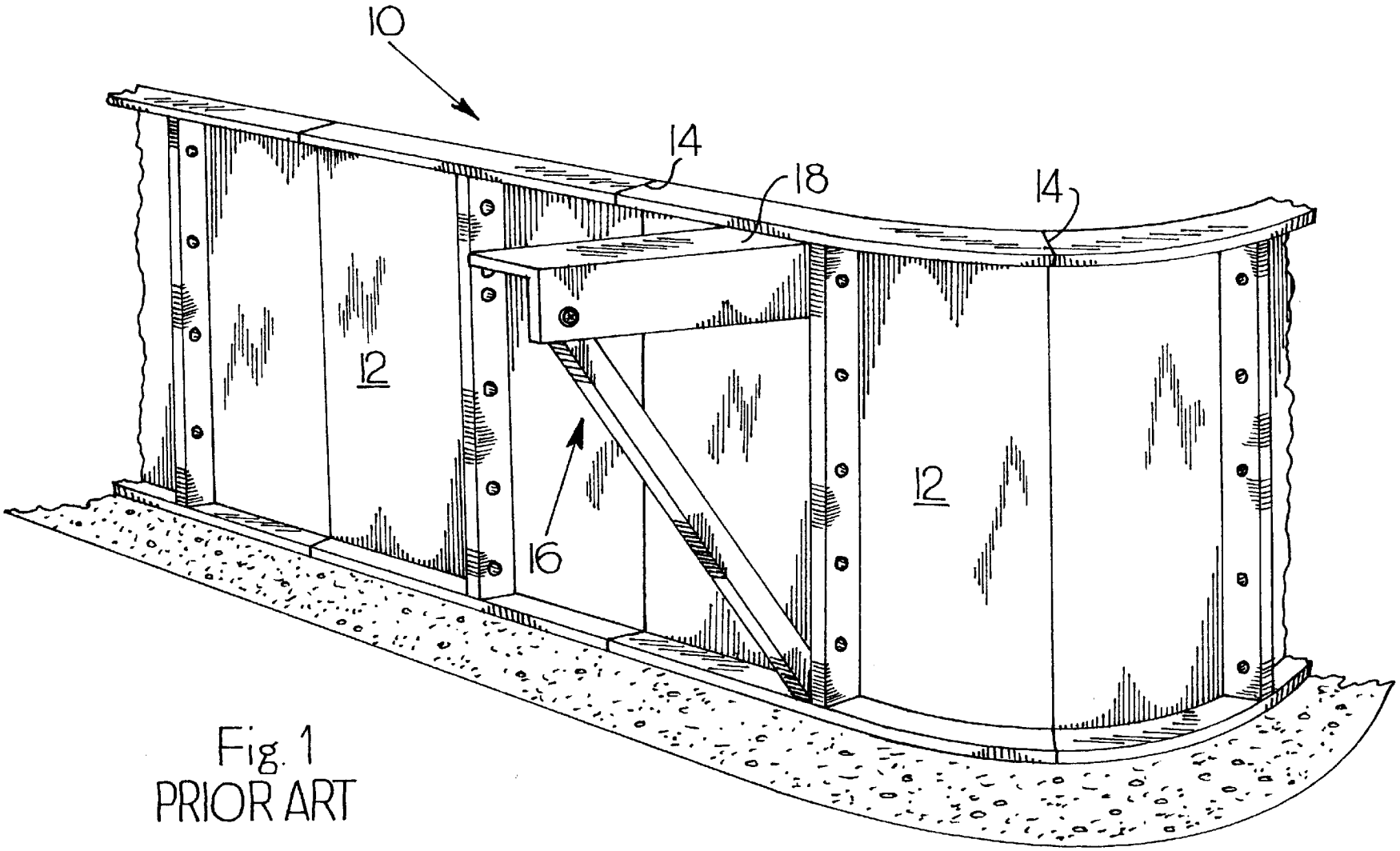
Fig. 1 PRIOR ART
FIG. 1 is a perspective view of a portion of a prior art in-ground swimming pool having a conventional deck brace attached thereto.

FIG. 1 shows a portion of a conventional in-ground pool 10 that includes a plurality of individual pool wall panels 12. The panels 12 are positioned in end-to-end relationship and secured together at terminal end edges 14. The adjacent pool wall panels 12 may be secured together by any method customary in the art. One of the panels 12 shown in FIG. 1 includes a brace member 16 connected thereto and extending outward from the panel 12. The brace member 16 includes a horizontally extending member 18. The brace member 16 is a typical metal or plastic brace member that is well-known in the art for supporting a swimming pool deck (not shown).

Figure 5:
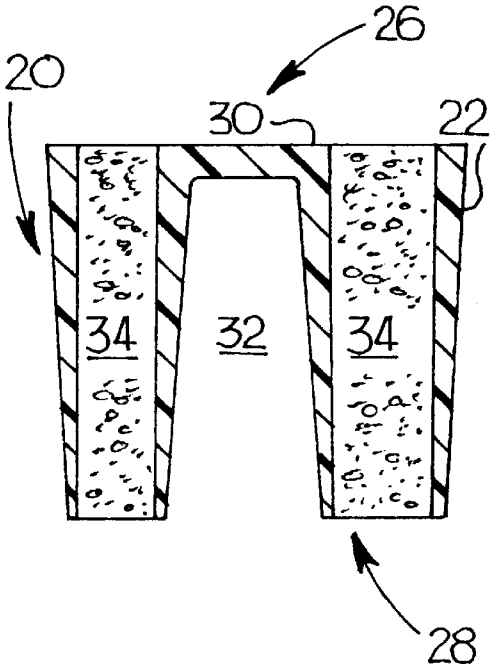
FIG. 5 is a cross-sectional view of a third embodiment of the support shown in FIG. 2.
Figure 4:
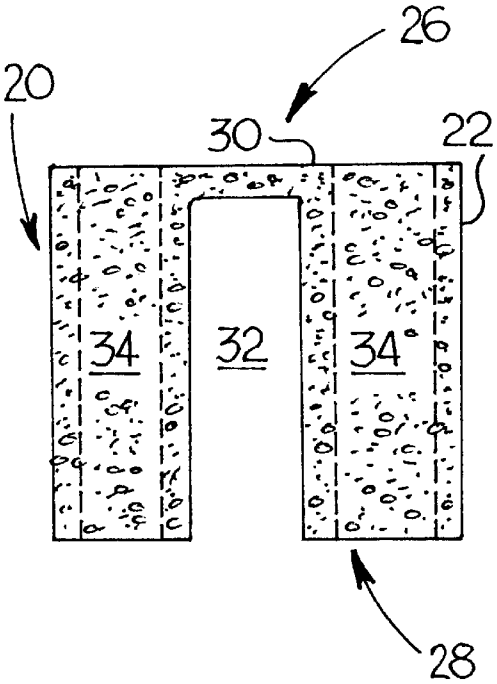
FIG. 4 is a cross-sectional view of a second embodiment of the support shown in FIG. 2.
Figure 3:
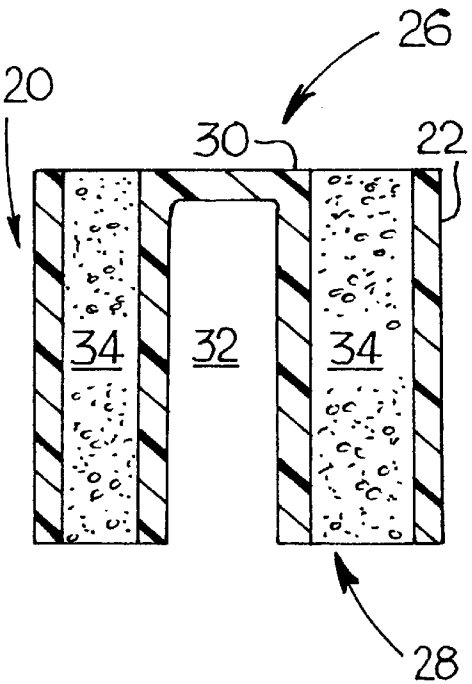
FIG. 3 is a cross-sectional view of the support shown in FIG. 2.

Referring now to FIGS. 2–5, a support 20 made in accordance with the present invention is shown. The support 20 generally includes a unitary shell member 22 defining two vertically extending chambers 24. The shell member 22 further includes a first end 26 and a second end 28. The chambers 24 are connected by a web 30 at the first end 26. The shell member 22 further defines a gap 32 extending from the web 30 to the second end 28 of the shell member 22 thereby separating the chambers 24. The chambers 24 are generally filled with concrete 34. The concrete 34 may include metal reinforcement members 36, or rebar, positioned therein. The unitary shell member 22 may be made of plastic such as polyethylene, or may be provided as a preformed concrete structure which may then be filled with concrete as shown in FIG. 4. As shown in FIG. 5, the shell member 22 may taper inward toward the second end 28 thereby facilitating the stacking of multiple supports 20 for easy transport. The tapering of the shell member 22 allows the supports 20 to be nested together for easy transportation to a job site. Each of the chambers 24 is typically filled with concrete 34 and generally has a rectangular cross section.

Figure 2:
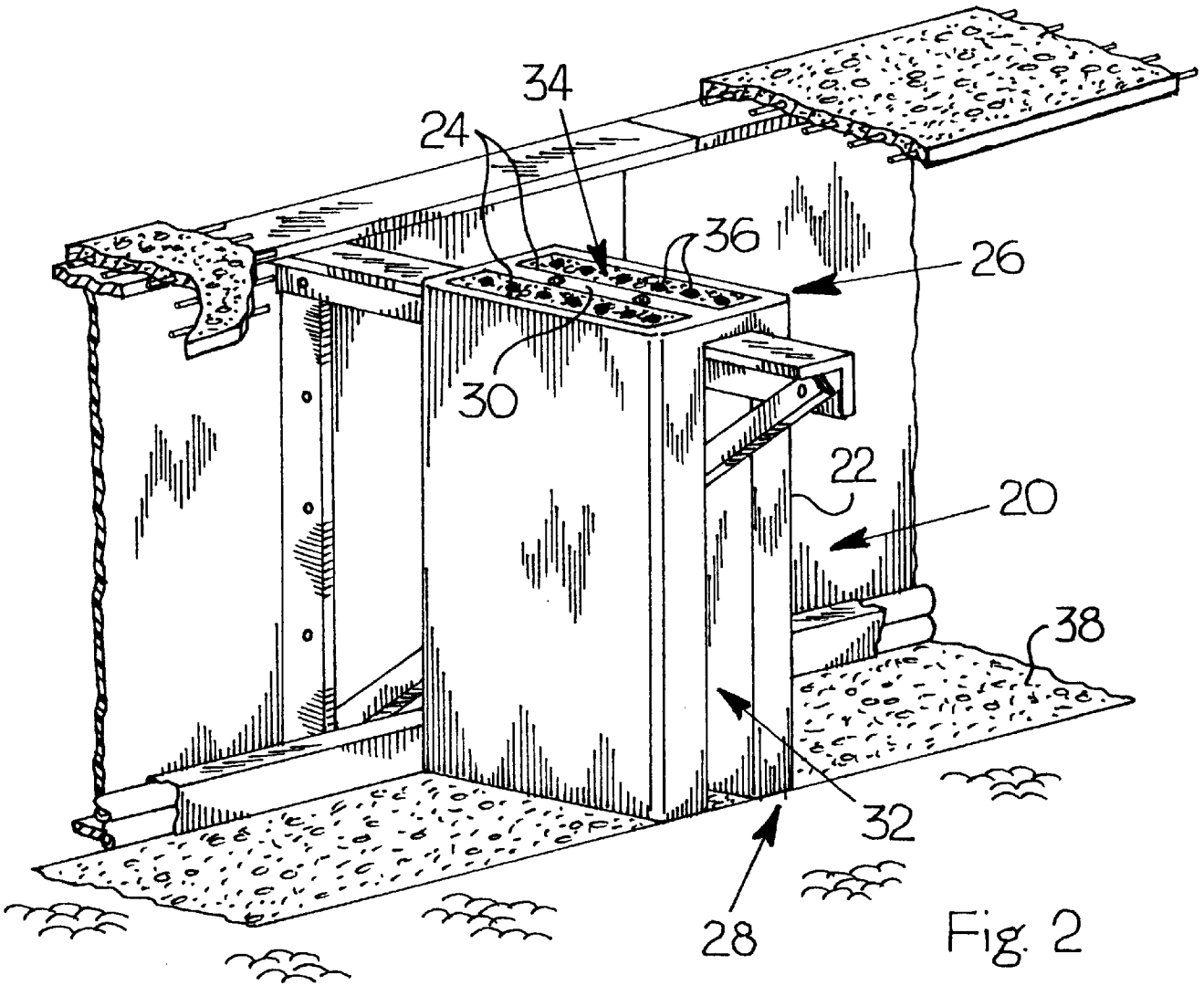
FIG. 2 is a perspective view of a support for a swimming pool deck and pool wall made in accordance with the present invention.

In the preferred embodiment of the support 20, the chambers 24 have open ends at the first end 26 and at the second end 28 of the shell member 22. The open ends enable concrete, when poured into the chambers 24, to flow through the chambers 24 and out the open ends at the second end 28 of the shell member 22 to create a monolithic concrete structure with the concrete material of a bond beam, or pool wall footer, that generally extends around the perimeter of a swimming pool as is well-known in the art. A portion of a typical pool wall footer 38 is shown in FIG. 2. In addition, the support 20 can be formed to have two closed ends and be provided with an opening to each of the chambers 24 for admitting concrete or another settleable material to the interior of the chambers 24.

Figure 6:
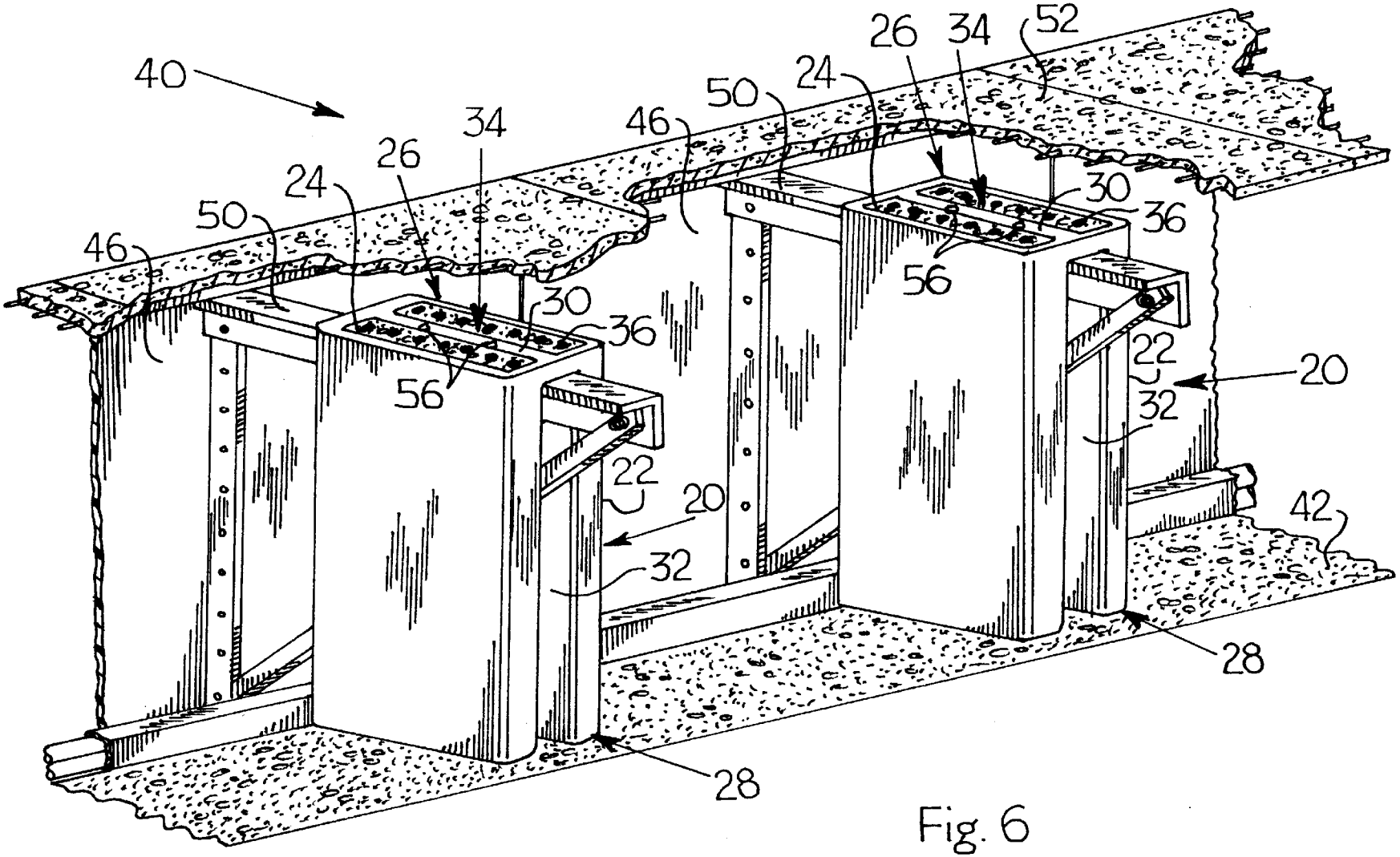
FIG. 6 is a perspective view of a swimming pool deck and pool wall support system in accordance with the present invention and utilizing the support shown in FIG. 2.
Figure 7:
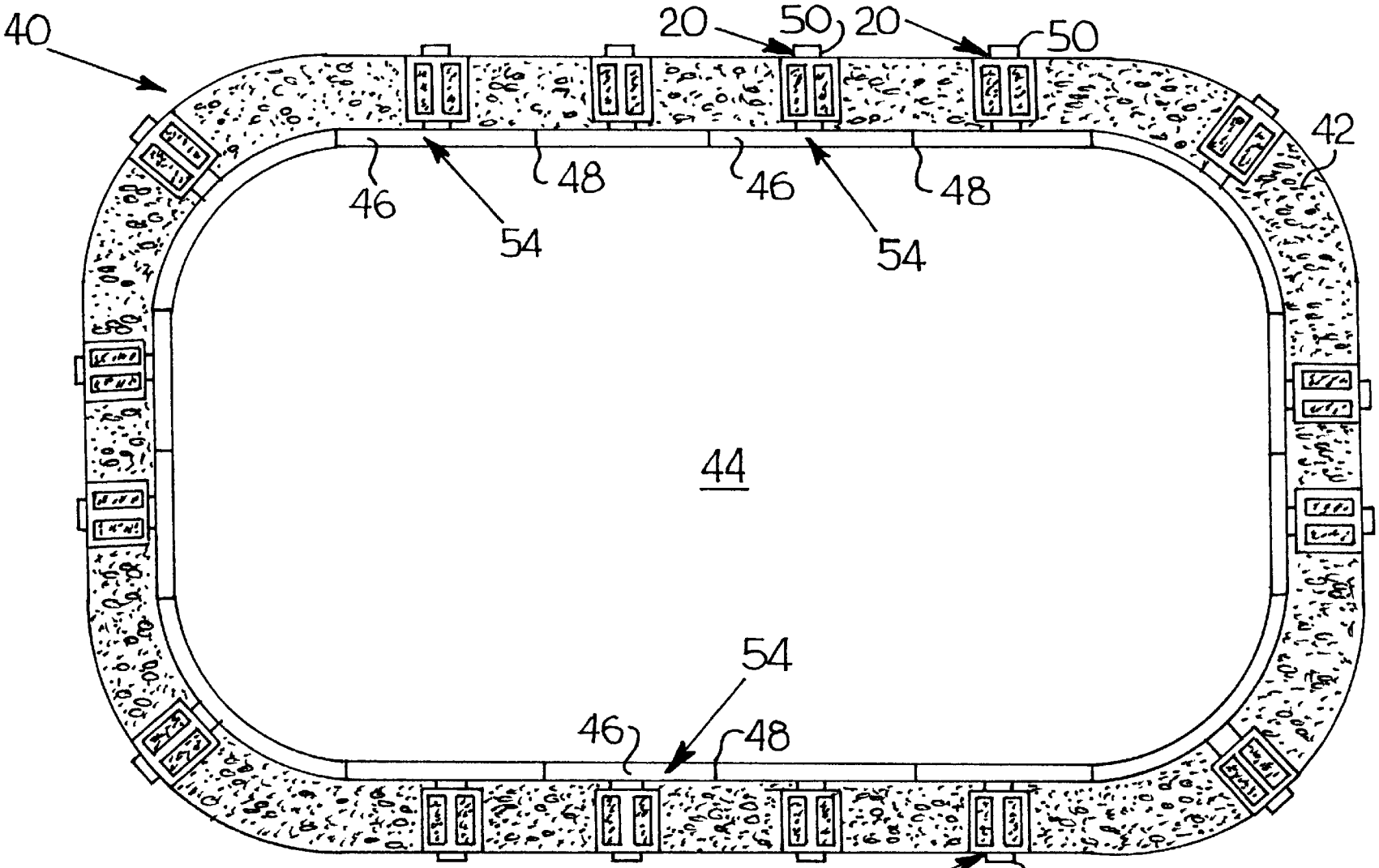
FIG. 7 is a plan view of the system shown in FIG. 6 extending around a perimeter of a swimming pool.

The present invention is also a swimming pool deck and pool wall support system. Referring to FIGS. 6 and 7, a swimming pool deck and pool wall support system in accordance with the present invention is generally designated with reference numeral 40. The system includes a pool wall footer 42 that generally defines a perimeter of a swimming pool 44. A plurality of pool wall panels 46 is generally positioned in end-to-end relationship and secured together at terminal end edges 48. The panels 46 extend around the perimeter of the swimming pool 44. The panels 46 are each further secured at one end to the pool wall footer 42 as is well-known in the art. The panels 46 generally each include at least one brace member 50 attached thereto and which extends outward therefrom. The brace members 50 preferably extend substantially horizontally outward from the pool wall panels 46.

A plurality of the supports 20, as discussed hereinabove, is positioned to cooperate with the brace members 50. In particular, the brace members 50 cooperate with the supports 20 such that for each of the brace members 50, the respective brace member 50 extends through the gap 32 defined by the shell member 22 of each of the supports 20. A swimming pool deck 52 is then supported on an upper edge 54 of each of the panels 46 and on the supports 20. The shell member 22 of each of the supports 20 is preferably secured to the respective brace members 50 with fasteners 56, such as "teck screws", which are well-known in the art. The fasteners 56 preferably extend through the web 30 connecting the chambers 24 of the shell member 22 of each of the supports 20. The supports 20 through their respective webs 30 and the fasteners 56 act to at least partially absorb and restrain the outward water pressure on the panels 46 when the swimming pool 44 is filled with water. Hence, the support system 40 is both a swimming pool deck and pool wall support system. It will be apparent to those skilled in the art that the brace members 50 may be dispensed with entirely and the supports 20 and the panels 46 be used alone as a swimming pool deck support system to support the weight of the swimming pool deck 52. The system 40 of FIG. 7 is shown without the swimming pool deck 52 for clarity.

The supports 20 are used to support the swimming pool deck 52 as discussed hereinafter. The supports 20 are positioned to cooperate with the respective brace members 50 extending from the panels 46 such that each of the brace members 50 extends through the gap 32 defined by the shell member 22 of each of the supports 20. The chambers 24 of the shell member 22 of each of the supports 20 are then filled with concrete 34. The concrete 34 is permitted to cure and set. The swimming pool deck 52 is then positioned on the supports 20 and on the upper edges 54 of the panels 46 and thereby supported by the supports 20 and the panels 46. As stated previously, the shell member 22 of each of the supports 20 may be fastened to the respective brace members 50 with fasteners 56 that extend through the web 30 connecting the chambers 24 of the shell member 22 of the supports 20. The supports 20 thus provide a restraining force acting against the outward water pressure on the panels 46 when the swimming pool is filled with water.

Figure 8:
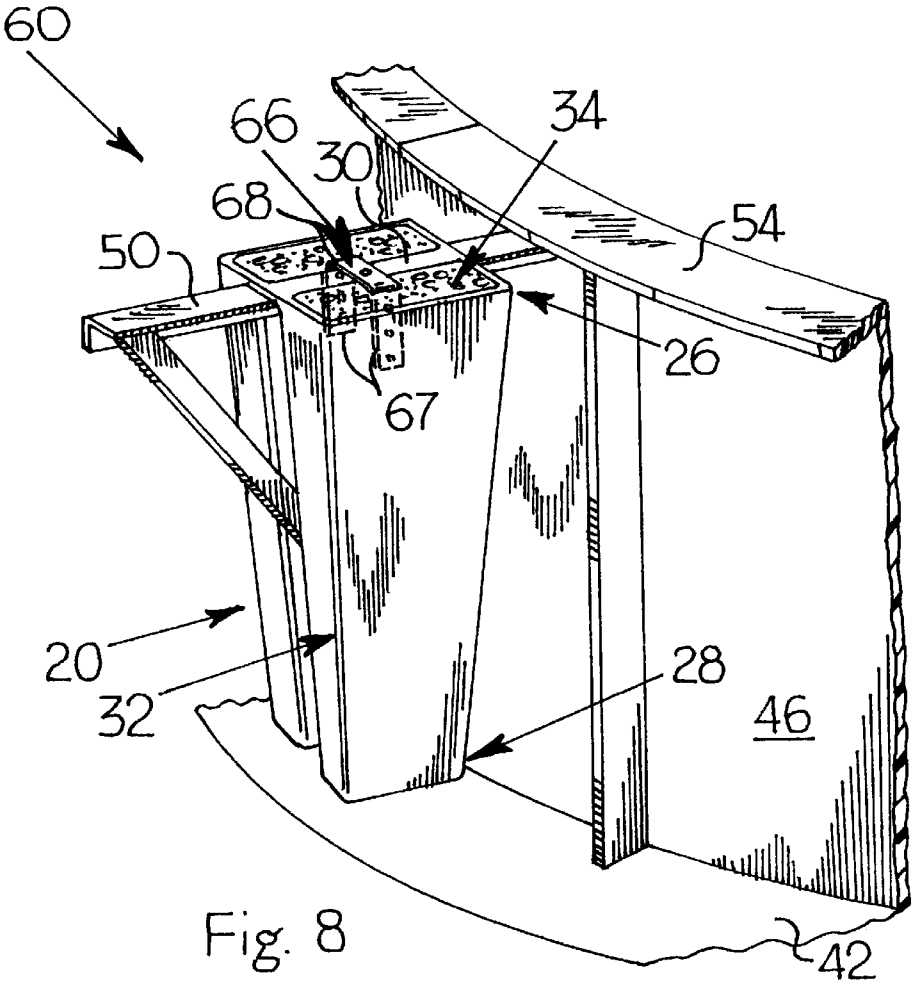
FIG. 8 is a perspective view of an alternative embodiment of the swimming pool deck and pool wall support system in accordance with the present invention.

Referring to FIG. 8, an alternative embodiment of the swimming pool deck and pool wall support system in accordance with the present invention is shown and generally designated with reference numeral 60. An alternative embodiment of the support 20 made in accordance with the present invention is shown in FIGS. 8–10.

Figure 9:
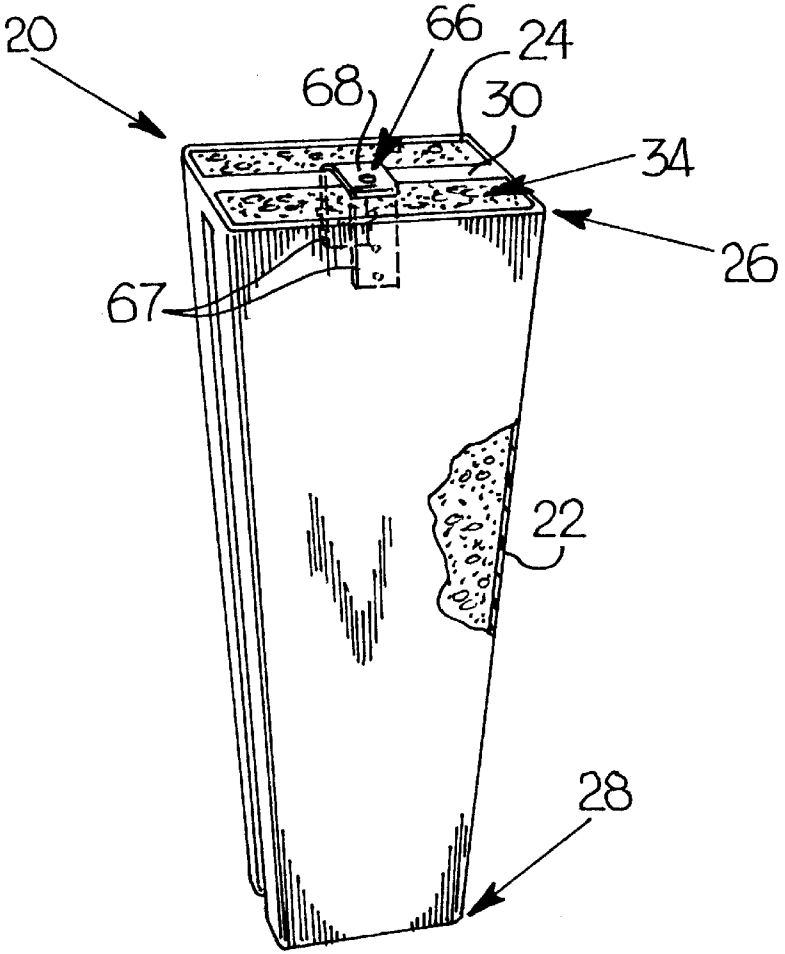
FIG. 9 is a perspective view of a support used in the system shown in FIG. 8.
Figure 10:
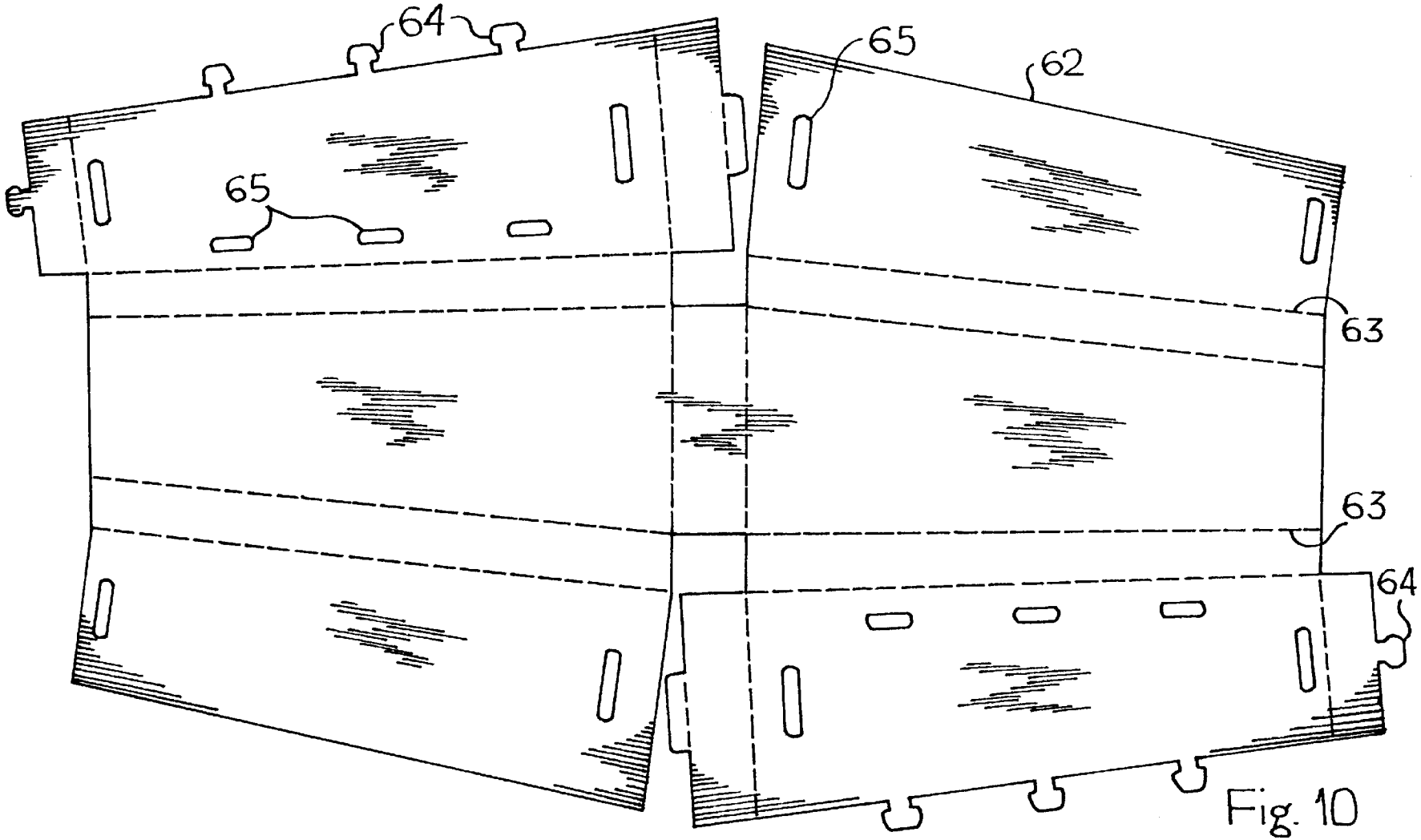
FIG. 10 is a plan view of a preformed blank used to form the support shown in FIG. 9.

Referring to FIGS. 8–10, the support 20 shown in FIGS. 8–10 is identical in all respects to the support 20 shown in FIGS. 2–7 discussed previously, with the exception that the shell member 22 is formed from a preformed blank 62 as illustrated in FIG. 10. The preformed blank 62 is a unitary member that is preferably made of cardboard and, in particular, 350 lb. cardboard. As shown in FIG. 10, the preformed blank 62 includes a plurality of folds 63 along which the preformed blank 62 is folded to form the general shape of the shell member 22. The preformed blank 62 also includes a plurality of tabs 64 and a plurality of cooperating openings 65 into which the tabs 64 fit. The tabs 64 may be sized slightly larger than the openings 65 so that the tabs 64, once forced through the openings 65, are prevented from slipping back through the openings 65. Once the preformed blank 62 is formed into the shape of the shell member 22, the resulting shell member 22, as shown in FIG. 9, is filled with concrete 34 in a similar manner to the support 20 discussed previously. The side of the preformed blank 62 which will contact the curing concrete 34 may be treated with a moisture-proof seal which prevents the cardboard of the preformed blank 62 from deteriorating while the concrete 34 positioned within the chambers 24 of the shell member 22 is curing.

Referring in particular to FIG. 8, the support 20 formed by the preformed blank 62 cooperates in a similar manner with the brace member 50 extending from the respective pool wall panels 46 as the support 20 discussed previously in connection with FIGS. 6 and 7. In particular, the brace member 50 extends through the gap 32 defined by the shell member 22 of the support 20. A substantially U-shaped bracket 66 is then used to attach the support 20 to the brace member 50. The bracket 66 includes two ends 67. The ends 67 are embedded respectively in the concrete 34 in the chambers 24 of the shell member 22. A cross piece portion 68 of the bracket 66 extends across the web 30 of the support 20. The cross piece portion 68 is configured to attach to the brace member 50 extending from the panel 46 with at least one fastener, such as a "teck screw" which was discussed previously. The bracket 66 is preferably made of metal such as galvanized steel or aluminum and is placed in the concrete 34 located within the chambers 24 of the support 20 while the concrete 34 is still curing and not fully hardened.

The shell member 22 formed by the preformed blank 62, after the concrete 34 has cured, may be left around the hardened concrete 34 or removed. Consequently, in an in-ground pool situation the cardboard shell member 22 may be left in place around the concrete 34 and earth and other filler material backfilled around the support 20. The cardboard shell member 22 left in place in the earth and filler material will deteriorate over time. In an aboveground pool situation, the cardboard shell member 22 is preferably removed from the fully formed support 20. The support 20 shown in FIG. 8 will support a swimming pool deck (not shown) in a similar manner to the support 20 shown in FIGS. 6 and 7.

Accordingly, the present invention provides a support for a swimming pool deck and pool wall that easily cooperates with conventional deck bracing, is easily transportable and may be positioned at any distance from a swimming pool wall. The present invention has been described with reference to preferred embodiments which are merely illustrative of the present invention and not restrictive thereof. Obvious modifications and alterations of the present invention may be made without departing from the spirit and scope of the invention. The scope of the present invention is defined in the appended claims and equivalents thereto.

What is claimed is:

1. A support for a swimming pool deck and pool wall, comprising:

a unitary shell member having inner and outer sidewalls when viewed in vertical cross section and defining two vertically extending chambers each filled with concrete, wherein at a first end of the shell member the inner sidewalls are connected by a web, and wherein a gap is defined between the inner sidewalls, the gap extending from the web to a second end of the shell member such that the chambers are isolated from each other.

2. The support of claim 1, wherein the shell member is formed by a preformed blank configured to be foldable into the shape of the shell member.

3. The support of claim 2, further including a substantially U-shaped bracket having two ends and a connecting cross piece portion, with the ends embedded respectively in the concrete in the chambers defined by the shell member and with the cross piece portion extending across the web connecting the chambers, wherein the cross piece portion is configured to attach to a brace member extending from a swimming pool wall with at least one fastener.

4. The support of claim 2, wherein the preformed blank is made of cardboard.

5. The support of claim 1, wherein the shell member is made of plastic.

6. The support of claim 1, wherein the shell member is a preformed concrete structure.

7. The support of claim 1, wherein the sidewalls of the shell member are thicker at the first end than at the second end.

8. The support of claim 1, wherein the chambers each have an open end located at the second end of the shell member.

9. A swimming pool deck and pool wall support system, comprising:

a pool wall footer defining a perimeter of a swimming pool;

a plurality of pool wall panels positioned in end-to-end relationship and secured together at terminal end edges, wherein the pool wall panels are each further secured at one end to the pool wall footer;

at least one brace member attached to each of the pool wall panels and extending outward therefrom;

a plurality of supports each including a unitary shell member defining two vertically extending chambers each filled with concrete, wherein at a first end of the shell member the chambers are connected by a web, wherein the shell member further defines a gap extending from the web to a second end of the shell member and separating the chambers, and wherein the brace members cooperate with the supports such that for each of the brace members, the brace member extends through the gap defined by the shell member of each of the supports; and a swimming pool deck supported by the pool wall panels and the supports.

10. The system of claim 9, wherein the shell member of each of the supports is formed by a preformed blank configured to be foldable into the shape of the shell member.

11. The system of claim 10, further including a substantially U-shaped bracket cooperating with the shell member of each of the supports, wherein the bracket includes two ends and a connecting cross piece portion, with the ends embedded respectively in the concrete in the chambers defined by the shell member and with the cross piece portion extending across the web connecting the chambers, wherein the cross piece portion is configured to attach to the respective brace members with at least one fastener.

12. The system of claim 10, wherein the preformed blank is made of cardboard.

13. The system of claim 9, further including reinforcement bars positioned in the concrete in the chambers defined by the shell member of each of the supports.

14. The system of claim 9, wherein the shell member of each of the supports is made of plastic.

15. The system of claim 9, wherein the shell member of each of the supports is a preformed concrete structure.

16. The system of claim 9, wherein the sidewalls of the shell member of each of the supports are thicker at the first end than at the second end.

17. The system of claim 9, wherein the shell member of each of the supports is secured to the respective brace members with fasteners, and wherein the fasteners extend through the web connecting the chambers of the shell member.

18. The system of claim 9, wherein the chambers defined by the shell member of each of the supports each have an open end located at the second end of the shell member, and wherein the second end is in contact with the pool wall footer such that when the chambers of the shell member of each of the supports are filled with concrete the concrete forms a monolithic structure with the pool wall footer.

19. A method of supporting a swimming pool deck and pool wall, comprising the steps of:

providing a plurality of supports each including a unitary shell member defining two vertically extending chambers, wherein at a first end of the shell member the chambers are connected by a web, and wherein the shell member further defines a gap extending from the web to a second end of the shell member and separating the chambers;

positioning the supports to cooperate with a plurality of brace members extending from a swimming pool wall such that each of the brace members extends respectively through the gap defined by the shell member of each of the supports;

fastening the shell member of each of the supports to the respective brace members with fasteners;

filling the chambers of the shell member of each of the supports with concrete;

curing the concrete; and supporting a swimming pool deck on the supports and the swimming pool wall.

20. The method of claim 19, further including the steps of:

providing the shell member of each of the supports as a preformed blank;

folding the preformed blank into the shape of the shell member for each of the supports; and attaching the shell member of each of the supports to the respective brace members with a U-shaped bracket configured to cooperate with the shell member, wherein the bracket includes two ends and a connecting cross piece portion, with the ends embedded respectively in the concrete in the chambers defined by the shell member and with the cross piece portion extending across the web connecting the chambers, wherein the cross piece portion attaches to the respective brace members with at least one fastener.

* * * * *